United States Patent [19]

Bauer

[11] 4,340,107

[45] Jul. 20, 1982

[54] CERAMIC SHELL MOLDING APPARATUS AND METHODS

[75] Inventor: Timothy R. Bauer, Euclid, Ohio

[73] Assignee: Precision Metalsmiths, Inc., Cleveland, Ohio

[21] Appl. No.: 898,763

[22] Filed: Apr. 20, 1978

[51] Int. Cl.[3] ..... B22C 9/04; B22C 13/08

[52] U.S. Cl. ..... 164/35; 164/165; 164/350; 164/361

[58] Field of Search ..... 164/25, 26, 165, 166, 164/361, 35, 350; 118/426

[56] References Cited

U.S. PATENT DOCUMENTS 3,249,972 5/1966 Watts et al. ..... 164/26
4,040,466 8/1977 Horton et al. ..... 164/361 X

FOREIGN PATENT DOCUMENTS 1280492 10/1968 Fed. Rep. of Germany ..... 164/165
1308911 3/1973 United Kingdom ..... 164/166

*Primary Examiner*—Gus T. Hampilos
*Attorney, Agent, or Firm*—Watts, Hoffmann, Fisher & Heinke Co.

[57] ABSTRACT

Method and apparatus for producing ceramic shell molds characterized in that a plurality of pattern set-ups are arranged with their longitudinal axes transverse to an axis of rotation and are rotated as a group while applying fluent refractory material to produce either a multiple number of molds or a single mold. A ceramic shell mold characterized by a main sprue passage, a plurality of transverse sprue passages extending therefrom, and casting cavities gated into the transverse passages.

3 Claims, 8 Drawing Figures

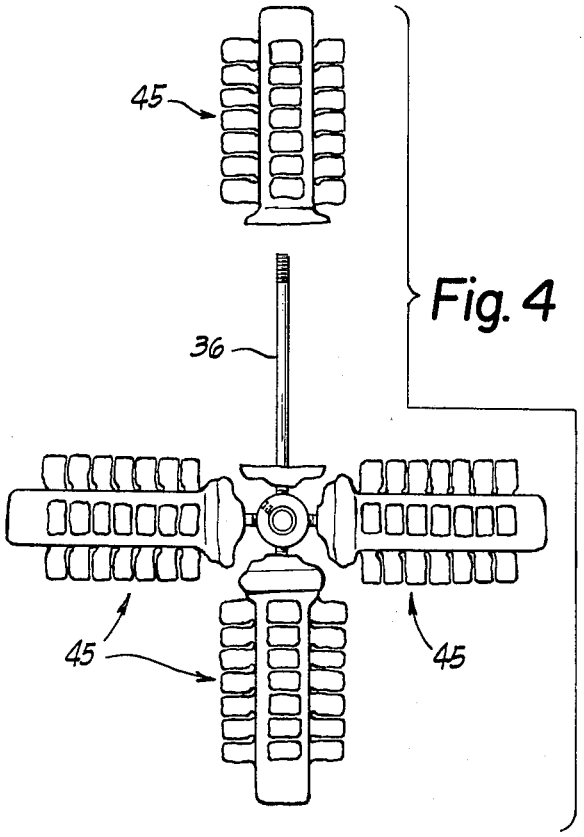
Fig. 4
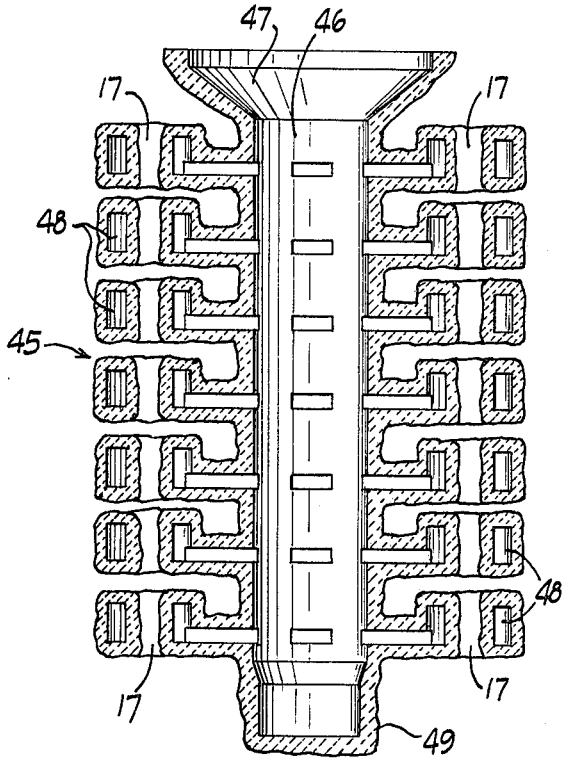
Fig. 5
Fig. 6
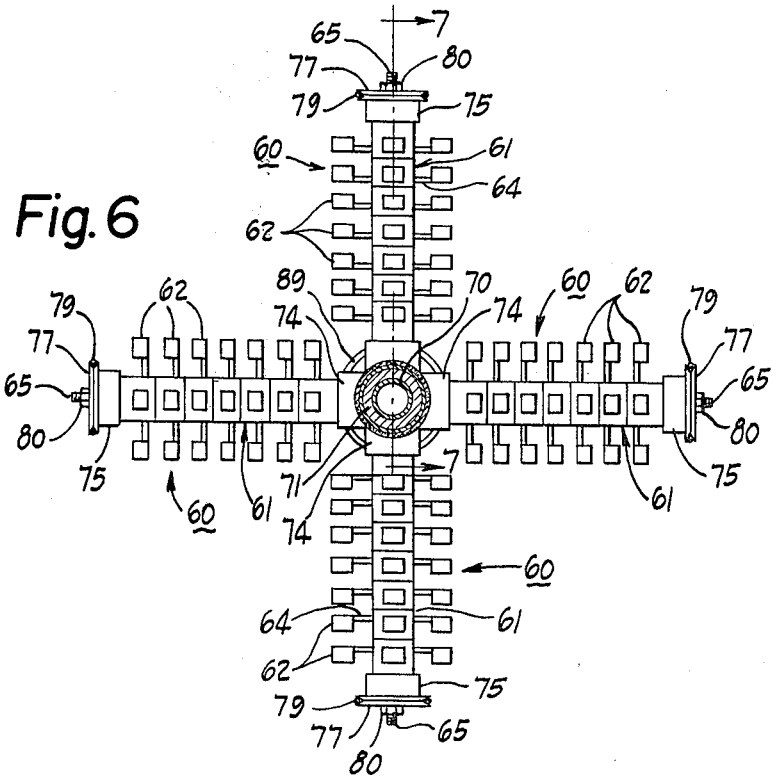

CERAMIC SHELL MOLDING APPARATUS AND METHODS

BACKGROUND OF THE INVENTION

This invention relates generally to the art of investment casting, and more specifically to ceramic shell molding techniques of precision casting wherein shell molds suitable for casting metal are prepared by building up layers of refractory material around disposable patterns which are subsequently removed from the mold.

As is known to those familiar with the art of investment casting, ceramic shell molds are prepared using patterns which are replicas of the parts to be cast in metal and which are formed of an expendable material. These patterns are attached to a sprue member to form what is known as a "set-up". The formation of the shell mold around the set-up is accomplished by dipping it into a refractory slurry of controlled viscosity followed by directional draining to coat the patterns uniformly. After draining excess slurry from the set-up, the slurry coating is sanded or stuccoed while wet with coarser refractory particles, such as by dipping the set-up into an air-fluidized bed of dry refractory material. The result is a coat of ceramic material having refractory particles embedded in the surface. This coat is hardened, usually by air drying at room conditions. After the first coat is sufficiently hard and dry, the steps of dipping, draining, stuccoing and drying are repeated until a refractory shell having a sufficient thickness to resist the stresses occurring in subsequent operations have been built up aroung the set-up. The usual shell thickness is from $\frac{1}{8}$ inch to about $\frac{1}{2}$ inch; although thicker or thinner shells may be formed for special situations. The set-up including the disposable patterns is then removed from the shell mold and the mold prepared for the casting operation.

The present invention is particularly concerned with an improvement in the ceramic shell molding technique and apparatus of U.S. Pat. Nos. 3,812,898 and 3,871,440 issued May 28, 1974 and Mar. 18, 1975, respectively, to Robert A. Horton. As disclosed in those patents, several pattern set-ups are processed as a group through the shell building operations. The several set-ups are arranged horizontally in ferris-wheel fashion between a pair of end plates. The entire array of circumferentially spaced pattern set-ups is rotated about a horizontal axis to cause each set-up to be moved about the axis between a lowered position in which the set-up is at least partially immersed in fluent ceramic shell material and a raised position.

The technique of applying refractory coatings to a plurality of set-ups in a single operation reduces the cost of making the shell molds and offers additional advantages which are of particular benefit to investment foundries whose operations are limited by the capacity of their melting furnaces and other equipment and which do not require the sophisticated mold-making apparatus of the size used by larger foundries.

SUMMARY OF THE INVENTION

The present invention provides new techniques and apparatus for processing a plurality of pattern set-ups at one time during the shell building operations. In a first embodiment the pattern set-ups are used to form a multiple number of ceramic shell molds. In a second embodiment of the invention, a single, novel ceramic shell mold is produced around the several pattern set-ups.

The assembly comprising one aspect of the invention generally includes a fixture rotatable about a horizontal axis and a plurality of pattern set-ups carried by the fixture, the set-ups being arranged with their longitudinal axes transverse to the axis of rotation. In the first preferred embodiment the pattern set-ups are arranged in groups at spaced locations along the length of the fixture and an individual shell mold is formed around each set-up. The second preferred embodiment of the invention comprises a main sprue member, a plurality of pattern set-ups, each including a sprue member and attached patterns, connected to the main sprue member transverse to its axis, and structure for rotating the assembly about the axis of the main sprue member so that a single ceramic shell mold is formed around the entire assembly.

Another aspect of the invention is the provision of a new ceramic shell mold which is produced using several pattern set-ups, each of which may constitute a different casting system. The new mold is characterized by a main body portion having a main sprue passage open on end of the mold, and a plurality of arms extending from the main body portion, each of the arms having a plurality of casting cavities and a sprue passage connecting the cavities to the main sprue passage. The mold is preferably made so that the distal ends of the arms are initially open to facilitate the pattern removal operation. The open ends are then closed, as by refractory plugs, so that molten metal can be cast into the mold.

The methods which constitute still another aspect of the invention generally comprise the steps of mounting an array of pattern set-ups for rotation about a horizontal axis, the pattern set-ups being arranged with their axes transverse to the horizontal axis, and rotating the array while applying fluent refractory material to the set-ups. The set-ups may be spaced along the rotation axis and the refractory material applied to the set-ups to form individual molds. Alternatively, the set-ups may be attached to a main sprue member and the refractory material applied to all of the set-ups to form the single mold described above.

The different embodiments of the invention achieve all of the advantages described in U.S. Pat. Nos. 3,812,898 and 3,871,440. For example, the several set-ups which are simultaneously processed may be made up of different casting patterns. The practice of the invention therefore makes it possible to form in one operation either a multiple number of molds or a single mold having different casting systems. This versatile procedure reduces mold handling time and the costs of casting production.

The invention offers several additional advantages over those obtained with the inventions of U.S. Pat. Nos. 3,812,898 and 3,871,440. The new apparatus does not employ end plates to hold the array of pattern set-ups. These end plates became coated with ceramic slurry during the mold-making operation. The slurry deposited on the end plates was wasted, since it formed on part of the casting molds. In addition, the excess material could make the assembly excessively heavy. When the assemblies were being handled manually, it was sometimes necessary to omit some of the patterns in order to keep the weight at a convenient level. When the end plates were made so that they could be re-used, it required extra labor after each coating operation to clean the plates.

In many instances, the new technique of attaching the individual pattern set-ups so that they are transverse to the axis of rotation which characterizes both embodiments of this invention, permits more set-ups to be included in an assembly of a given length and outer diameter than when the set-ups are arranged with their axes parallel to the axis of rotation. Since more patterns are included in an assembly of a given size, the overall costs of casting production are further reduced.

The individual molds made with the apparatus and methods of the present invention can be of a larger diameter than with the prior assembly. Since the set-ups are arranged with their axes transverse to the axis of rotation, the diameters of the set-ups are not limited by the maximum diameter of the assembly itself, which is in turn usually limited by the size of the dipping and stuccoing tanks.

Another advantage resulting from the practice of the invention is that for certain types of parts it leads to a more uniform application of slurry to the patterns and hence to a more uniform mold thickness and a reduction in wasted slurry. For example, when the casting patterns have holes or openings, it may be difficult to spin or drain excess slurry from within the openings when the set-ups are mounted parallel to the axis of rotation. The openings may be filled in solid with the slurry. This represents a waste of material, since the added thickness is not needed in the mold. In some instances, the packed material may not dry properly which can lead to mold cracking. The presence of excess slurry in the holes of the patterns also increases the time and cost of removing the mold material from the castings produced in the mold. When the same patterns are mounted in accordance with the present invention so that the axes of the set-ups are transverse to the axis of rotation, the pattern holes will not be filled in solid with slurry and the excess slurry will be drained from the patterns to form a uniform mold wall thickness.

Other advantages and a fuller understanding of the invention will be had from the following detailed description and the accompanying drawings.

BRIEF DESCRIPTION OF THE DRAWINGS

FIG. 4 is a partially exploded view similar to FIG. 2 after the pattern set-ups have been coated with refractory material to form ceramic shell molds.

FIG. 5 is an enlarged view in vertical cross section of a shell mold formed with the pattern assembly arrangement of FIGS. 1 and 2.

FIG. 6 is a vertical elevational view showing another embodiment of the invention.

DESCRIPTION OF THE PREFERRED EMBODIMENTS

Figure 1:
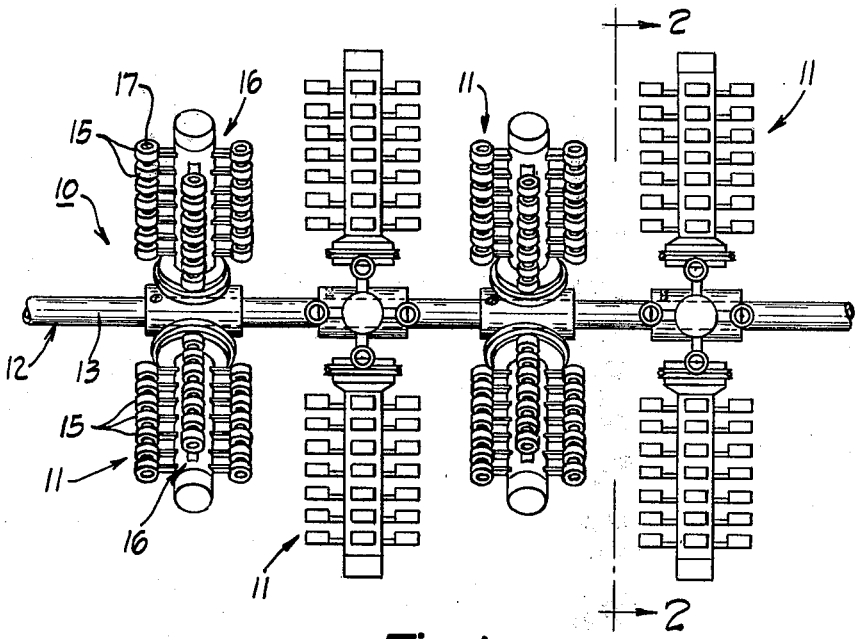
FIG. 1 is a side elevational view of an assembly of pattern set-ups arranged in accordance with one preferred embodiment of the present invention.
Figure 2:
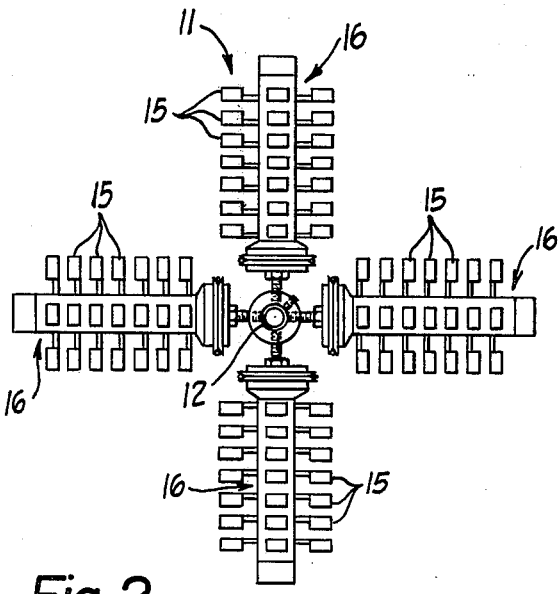
FIG. 2 is a vertical elevational view of the assembly taken generally on the line 2—2 of FIG. 1.
Figure 3:
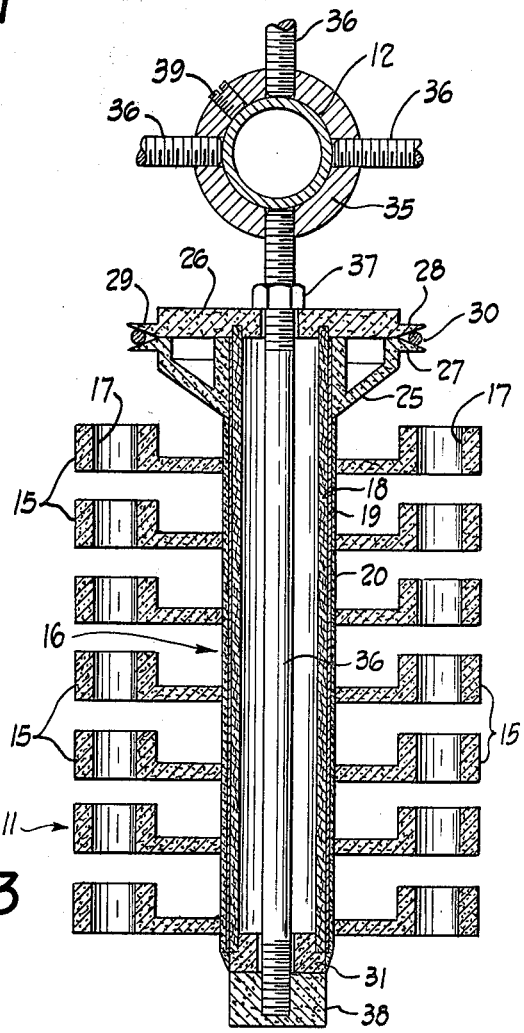
FIG. 3 is an enlarged, fragmentary view of the pattern assembly showing one of the set-ups in vertical cross section.

Referring now to the drawings, and to FIGS. 1–3 in particular, reference numeral 10 generally designates an assembly of pattern set-ups 11 arranged in accordance with a preferred embodiment of the invention so that all of the set-ups can be coated with refractory material in a single operation to form a multiple number of shell molds. The pattern set-ups 11 are supported by a rotatable fixture 12 which is comprised of a handle or rod 13. The several pattern set-ups 11 are disposed at spaced locations along the length of the handle 13 and are arranged with their longitudinal axes transverse to the handle. As shown, four set-ups 11 are equally spaced around the handle 13 at each location, but it is to be understood that the number of set-ups at each location can be varied.

Each of the set-ups 11 is of a typical construction including a plurality of casting patterns 15 that project from the outside wall of a sprue member 16. The patterns 15, which are replicas of the parts to be cast in metal and include the necessary gates, are formed of an expendable material, such as wax, a synthetic resin, or a wax and resin composition. The exemplary patterns 15 include holes 17 that extend through the patterns parallel to the longitudinal axis of the sprue member 16. Although all of the casting patterns 15 have been illustrated as identical, it will be understood that the set-ups may comprise several different patterns in order to produce a variety of castings.

The details of construction of the sprue members 16 do not form a part of the present invention, and the sprue members may be made in accordance with any conventional practice. The particular sprue member shown in FIG. 3 for illustrative purposes is cylindrical or tubular and comprises a cardboard tube 18 surrounded by a paper sleeve 19 and provided with a thin surface coating 20 of wax or the like. Alternatively, the tubular sprue members may be tubes made of an expendable pattern material. According to still another conventional practice, the sprue members may be of the so-called "rosette" type construction which is hereinafter described in connection with the embodiment of FIGS. 6–8. In accordance with another known practice, the sprue members may be of the type described in U.S. Pat. No. 3,520,350 dated July 14, 1970.

Each of the set-ups 11 includes a frusto-conical pouring cup pattern 25 made of wax or the like at one end of the sprue member 16. The pouring cup pattern 25 is illustrated in FIG. 3 as being hollow and as being closed at its base by a plate 26 also made of wax or the like. In the illustrated construction, a flange 27 extends around the base of the pouring cup pattern 25 and cooperates with a similar flange 28 around the plate 26 to form a groove 29. The groove 29 of each set-up is adapted to receive a wire 30 in the manner described in U.S. Pat. No. 4,040,466 dated Aug. 9, 1977. After a shell mold has been formed around the set-up, the wire 30 is unwrapped from the groove in order to separate the ceramic material at the base of the pouring cup pattern 25. The ends of the sprue members opposite the pouring cup patterns 25 are closed by plugs 31 made of wax or other expendable pattern material.

Collars 35 are provided on the handle 13 for the purpose of mounting the set-ups 11 at each of the spaced locations. The set-ups 11 are secured to these collars 35 by mounting rods 36 that extend axially through the sprue members 16. Still referring to FIG. 3, it will be seen that one end of the rod 36 extends through the plate 26 and is threaded into a hole in the collar 35. A nut 37 is threaded on the end of the rod against the plate 26 to hold the set-up in the desired position. The other end of the rod extends through the plug 31 and is threaded into an abutting disc member 38 made of the same material as the plug.

In the preferred embodiment of FIGS. 1–3, the several collars 35 are adjustable along the handle 13 so that the spacing of the set-up locations axially of the handle can be selectively changed. Each collar may be secured in its selected position in any suitable manner, as by a screw 39 or the like.

In use, the assembly comprising the several pattern set-ups 11 connected to the fixture 12 is mounted for rotation about the axis established by the handle 13. Preferably, the assembly is mounted for rotation above a tank containing fluent refractory material, i.e. slurry or an air-fluidized bed of dry refractory particles, in the manner generally described in U.S. Pat. No. 3,871,440. The assembly 10 is rotated so that the fluent refractory material coats the pattern set-ups as they are moved through the material in the tank. Alternate coatings of slurry and dry refractory particles are applied to the pattern set-ups until a separate ceramic shell mold of the desired thickness has been produced around each set-up as shown, for example, in FIG. 4.

Referring to FIG. 4, the refractory shell molds formed by the applications of slurry and dry refractory material are generally designated by reference numeral 45. When the ceramic shell material has hardened, the wires 30 are unwound from around the pouring cup patterns 25 in the manner described above to separate the mold material at the bases of the pouring cup patterns. This permits each mold 45 to be separated from the assembly simply by unthreading it from the supporting rod 36.

The pattern set-ups 11 are then removed from the molds 45 by the usual procedure which includes stripping the cardboard tubes 18 from the insides of the molds and heating the molds to melt the pattern material. As shown in FIG. 5, the removal of the sprue member 16 and the pouring cup pattern 25 produces a sprue passage 46 extending longitudinally of the mold and a pouring cup 47 at one end of the mold in communication with the sprue passage. The removal of the patterns 15 forms casting cavities 48 which are gated into the sprue passage 46.

The end of each mold 45 opposite the pouring cup 47 is closed by refractory material 49. If desired, the end of the mold formed by the material 49 can be opened prior to the pattern removal operation in order to facilitate heating of the mold and drainage of the molten pattern material. The open end of the mold opposite the pouring cup would then be closed in any suitable manner prior to filling the mold with molten metal.

The new procedure of arranging the pattern set-ups so that their longitudinal axes are transverse to the axis of assembly rotation is especially suitable for producing shell molds using patterns having configurations such as the holes 17. As shown in FIG. 5, the procedure results in the formation of a mold wall of substantially uniform thickness around the inner surfaces of the patterns defining the holes 17. When processing the same patterns according to the procedure of U.S. Pat. No. 3,812,898 in which the set-ups have their longitudinal axes parallel to the axis of assembly rotation, the holes 17 could be packed solid with the ceramic mold material. This excess mold material was difficult to dry properly so that the mold wall would not crack when the mold was heated for pattern removal. Also, it was difficult to remove the packed mold material from the holes of the castings during cleaning operations.

It will be seen that the diameters of the individual set-ups 11 are not limited by the maximum diameter of the assembly 10 in the plane shown in FIG. 2. In many instances, it is possible to process a greater number of patterns in one assembly than when the set-ups are arranged with their axes parallel to the axis of rotation as disclosed in U.S. Pat. No. 3,812,898.

Figure 7:
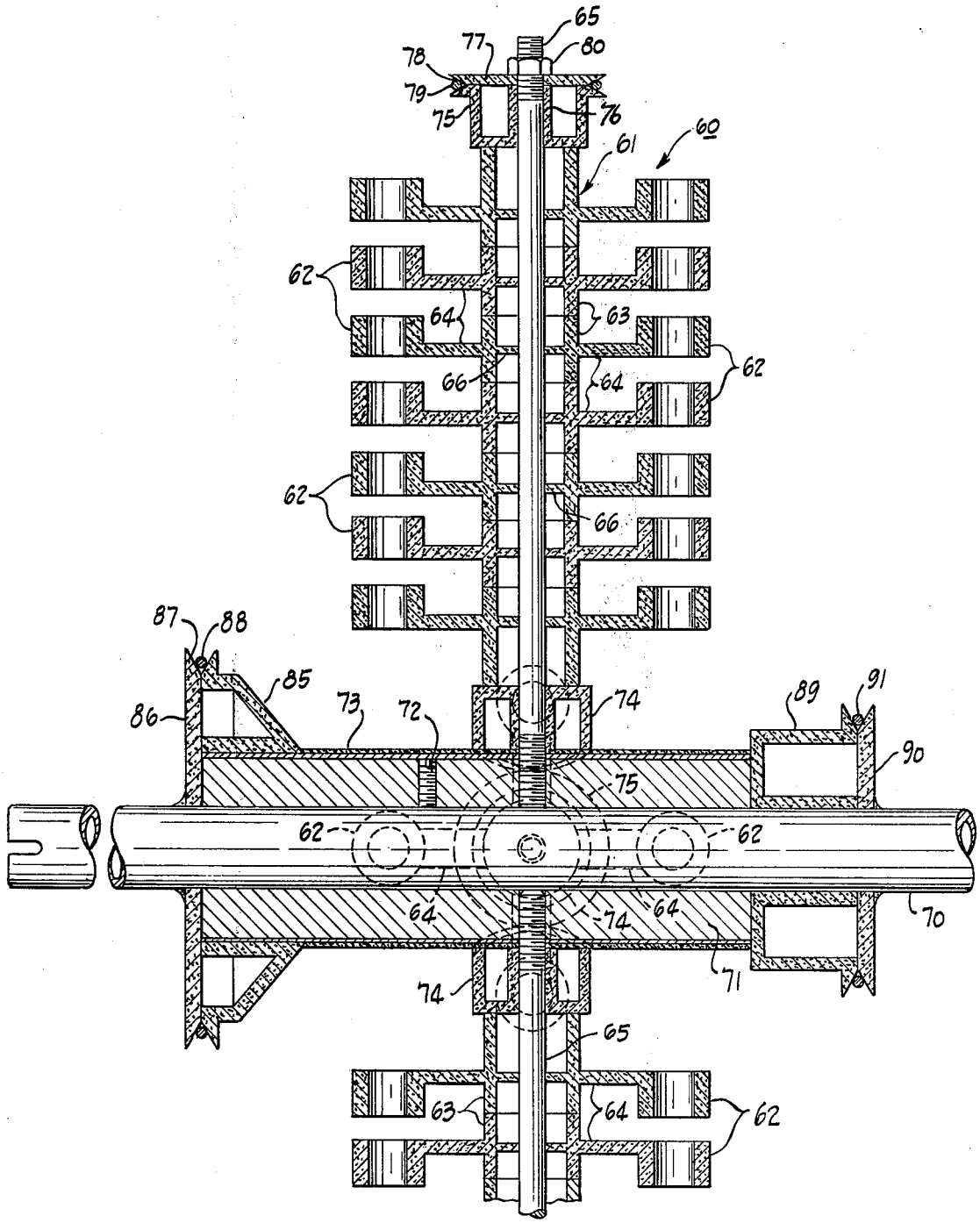
FIG. 7 is an enlarged cross-sectional view taken generally on the line 7—7 of FIG. 6.
Figure 8:
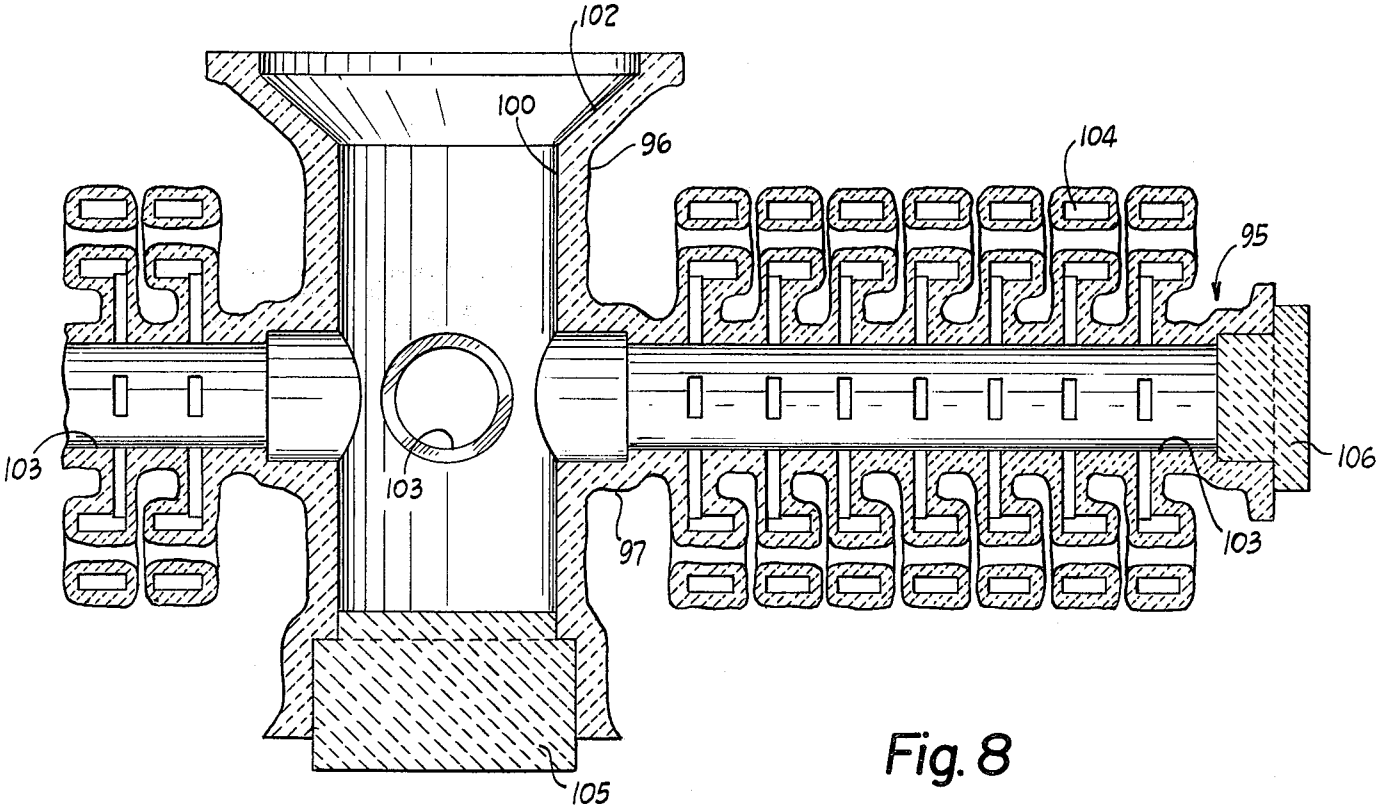
FIG. 8 is an enlarged, fragmentary cross-sectional view of a ceramic shell mold made with the pattern assembly arrangement of FIGS. 6 and 7.

Reference is now made to FIGS. 6–8 which illustrate an embodiment of the invention in which several pattern set-ups are processed at one time to form a single shell mold. Each of the set-ups is generally designated by reference numeral 60. As in the previously described embodiment of FIGS. 1–3, each of the set-ups 60 is comprised of a sprue member 61 and laterally attached patterns 62 which may be of the same or different shape.

The illustrated sprue member construction 61 is of the rosette type and is comprised of a plurality of individual cylindrical hubs 63 made of the same material as the patterns 62. The patterns 62 are arranged around and connected to the hubs 63 by gates 64. The separately formed hubs 63 are disposed in end-to-end engagement around a mounting rod 65. Each of the hubs has an apertured internal flange 66 through which the mounting rod 65 projects.

It will be understood that the above described construction of the sprue members 61 has been chosen only for the purpose of illustrating one practical application involving the teachings of the present embodiment of the invention and that substitute constructions known to those skilled in the investment casting art can be employed if desired. The construction of the sprue members 61 may, for example, be of any of the types described above in connection with the embodiments of FIGS. 1–3.

The pattern set-ups 60 are arranged circumferentially around a handle or center rod 70. A metal sleeve 71 is carried on the handle 70 for the purpose of mounting the set-ups 60 and is secured in place by a screw 72. The sleeve 71 preferably is wrapped with wax coated paper 73. Separate wax members 74 are wax welded to the outside of the wrapped sleeve 71 at circumferentially spaced locations to form seats against which the radially inner ends of the sprue members 61 are engaged.

The radially outer end of each set-up 60 is closed by a cup-shaped member 75 having an end wall abutting the adjacent hub 63 and an inner tubular wall 76 through which the rod 65 projects. The open end of the member 75 is closed by a plate 77. The cup-shaped member and the plate 77 are made of an expendable pattern material such as wax and include cooperating peripheral flanges that define a groove 78 for receiving a wire 79. The wires 79 are adapted to be unwound in the same manner as the previous described wires 30 in order to sever the subsequently formed ceramic shell material at the loactions of the grooves 78. The members 75, 77 are held on the ends of the rods 65 by nuts 80.

A pouring cup pattern 85 made of a suitable expendable material is carried on one end of the sleeve 71. A plate 86 made of the same material as the pattern 85 abuts against the pattern. The members 85, 86 cooperate to define a peripheral groove 87 which receives a wire strand 88.

Cooperating members 89, 90 similar to the previously described members 75, 77, respectively, are mounted on the handle 70 at the end of the sleeve 71 remote from the pouring cup pattern 85. The members 89, 90 have peripheral flanges which define a groove for receiving a wire strand 91.

The assembly comprising the several set-ups 60 which extend transversely and are connected to the sleeve 71 is mounted for rotation about the axis established by the handle 70. Fluent refractory material comprising alternate layers of slurry and dry refractory particles are applied to the set-ups in a single operation as described above in connection with the embodiments of FIGS. 1–3 to form a single refractory shell 95 around all of the set-ups.

The shell 95 which is shown in FIG. 8 is comprised of a main body portion 96 and laterally projecting arms 97. The main body portion 96 is formed around the sleeve 71 which functions as a main sprue forming member, the pouring cup pattern 85, and the member 89. The laterally projecting arms 97 of the shell are formed around the set-ups 60.

At the completion of the coating operation, the wires 79 are unwound from the grooves 78 to open the ends of the arms 97. This permits the rods 65 to be removed by unscrewing them through the open ends of the shell arms 97. The wires 88, 91 are removed to open each end of the main body portion 96, and the handle 70 including the sleeve 71 are withdrawn from the shell. The wax coated paper 73 can be stripped out from the inside of the main body portion 96.

The shell 95 is then subjected to a pattern removal operation in order to melt out the pattern set-ups 60, the members 75, 89, and the pouring cup pattern 85. The pattern removal operation is facilitated by the fact that both ends of the body portion 96 and the outer ends of the arms 97 of the shell are open.

As will be seen from FIG. 8, the removal of the various pattern members forms a main sprue passage 100 and a pouring cup 102 in the body portion 96 and lateral sprue passages 103 which extend through the arms 97 from the main sprue passage 100. Casting cavities 104 are formed in each of the arms 97, and these cavities are gated into the lateral sprue passages 103. Following the pattern removal operation, the end of the main sprue passage 100 and the ends of the arms 97 are closed, as by refractory plugs 105, 106, respectively.

It will be seen that the embodiment of FIGS. 6–8 has all of the advantages of the previously described embodiment of FIGS. 1–5. The several set-ups 60 are arranged with their longitudinal axes transverse to the axis of rotation established by the handle 70 so as to facilitate uniform coating of patterns having special configurations, such as holes extending through the patterns parallel to the axes of the set-ups. The diameters of the individual sprue members 61 are not limited by the maximum diameter of the entire assembly in the plane shown in FIG. 6.

In carrying out the embodiment of FIGS. 6–8, it is to be understood that additional pattern set-ups may be located at the spaced locations along an elongated sleeve 71 in order to form a single ceramic shell mold in which the lateral sprue passages 103 communicate with a main sprue passage at spaced locations along its length. It is also possible to mount several assemblies as shown in FIG. 7, along a single handle 70 in order to form several molds in a single operation, each being of the configuration shown in FIG. 8.

Many other modifications and variations of the invention will be apparent to those skilled in the art in light of the foregoing detailed disclosure. It is therefore to be understood that, within the scope of the appended claims, the invention can be practiced otherwise than as specifically shown and described.

What is claimed is:

1. In the production of refractory molds by the lost pattern process, a method comprising the steps of forming a pattern set-up assembly by connecting a plurality of pattern set-ups each including sprue means and attached patterns to a main sprue forming member so that the axes of said sprue means are transverse to the longitudinal axis of said sprue forming member, surrounding the assembly with a refractory shell having a main body portion around said sprue forming member and laterally projecting arms in which said set-ups are embedded, opening up at least one end of said main body portion and the ends of said arms, removing said sprue means and said sprue forming member from said mold and melting said patterns, and thereafter closing the open ends of said arms so that molten metal can be poured into said mold.

2. A ceramic shell mold comprising a one-piece refractory shell having a main body portion and radially extending arms, said main body portion defining a main sprue passage having an open end, and each of said arms defining a branch sprue passage having one end opening into said main sprue passage and a plurality of casting cavities gated into said branch passage, each of said branch passages being formed with an open end remote from said main passage to facilitate the removal of patterns from said cavities.

3. An assembly for use in producing refractory molds by the lost pattern process comprising a fixture rotatable about a horizontal axis, said fixture including a sleeve and a pouring cup pattern at one end of said sleeve, and a plurality of pattern set-ups connected and transverse to said sleeve, each of said set-ups defining a separate casting system including sprue means and casting patterns connected thereto, said pattern set-ups being arranged with their longitudinal axes transverse to the axis of rotation of said fixture.

* * * * *